US007228711B2

(12) United States Patent
Taras et al.

(10) Patent No.: US 7,228,711 B2
(45) Date of Patent: Jun. 12, 2007

(54) TUBES WITH ELONGATED CROSS-SECTION FOR FLOODED EVAPORATORS AND CONDENSERS

(75) Inventors: Michael F. Taras, Fayetteville, NY (US); Howard H. Fraser, Jr., New Woodstock, NY (US)

(73) Assignee: Carrier Corporation, Farmington, CT (US)

( * ) Notice: Subject to any disclaimer, the term of this patent is extended or adjusted under 35 U.S.C. 154(b) by 216 days.

(21) Appl. No.: 10/986,685

(22) Filed: Nov. 12, 2004

(65) Prior Publication Data

US 2006/0101848 A1 May 18, 2006

(51) Int. Cl.
*F25B 39/02* (2006.01)
*F28D 7/00* (2006.01)

(52) U.S. Cl. ..... 62/515; 165/159

(58) Field of Classification Search ..... 62/515, 62/527; 165/158–163
See application file for complete search history.

(56) References Cited

U.S. PATENT DOCUMENTS 3,306,353 A * 2/1967 Burne ..... 165/164
4,755,331 A 7/1988 Merrill et al.
4,981,171 A * 1/1991 Tippmann ..... 165/125
5,505,256 A * 4/1996 Boardman et al. ..... 165/166
5,520,015 A * 5/1996 Lukas et al. ..... 62/506
5,839,294 A 11/1998 Chiang et al.
6,178,770 B1 * 1/2001 Bradley et al. ..... 62/434
6,820,685 B1 * 11/2004 Carter et al. ..... 165/150

FOREIGN PATENT DOCUMENTS

WO WO 2004/016995 A1 * 2/2004

* cited by examiner

*Primary Examiner*—Mohammad M. Ali
(74) *Attorney, Agent, or Firm*—Marjama & Bilinski LLP

(57) ABSTRACT

In a shell-and-tube heat exchanger with the tubes disposed within the shell for conducting the flow of a fluid to be in heat transfer interaction with a refrigerant contained in the volume formed by the heat exchanger shell and the external surfaces of the tube bundle, the tubes are elongated in their cross-section, with the elongation axis being oriented in the vertical direction to thereby enhance the heat transfer process and potentially reduce the heat exchanger size or tube count. The design features can be applied to both flooded and falling film heat exchangers and are equally applicable to both evaporators and condensers.

18 Claims, 3 Drawing Sheets

TUBES WITH ELONGATED CROSS-SECTION FOR FLOODED EVAPORATORS AND CONDENSERS

BACKGROUND OF THE INVENTION

This invention relates generally to heat exchangers for air conditioning and refrigeration systems and, more particularly, to shell-and-tube heat exchangers with refrigerant contained inside in the volume confined between the shell and outside surfaces of the tubes.

Vapor compression systems for cooling water, or other secondary media such as glycol, commonly referred to as "chillers", are widely used in the air conditioning and refrigeration applications. Normally, such systems have relatively large cooling capacities, such as around 350 kW (100 ton) or higher and are used to cool large structures such as office buildings, large stores and ships. In a typical application applying a chiller, the system includes a closed chilled water flow loop that circulates water from the evaporator of the chiller to a number of auxiliary air-to-water heat exchangers located in the space or spaces to be conditioned.

A shell-and-tube type heat exchanger has a plurality of tubes contained within a shell. The tubes are usually arranged to provide multiple parallel flow paths for one of two fluids between which it is desired to exchange heat. In a flooded evaporator, the tubes are immersed in a second fluid. Heat passes from one fluid to the other fluid through the walls of the tubes.

Many air conditioning and refrigeration systems contain shell-and-tube heat exchangers. In air conditioning applications, a fluid, commonly water, flows through the tubes, and refrigerant is contained in the volume confined between the heat exchanger shell and outside surfaces of the tubes. In evaporator applications, the refrigerant cools the fluid by heat transfer from the fluid to the walls of the tubes and then to the refrigerant. Transferred heat vaporizes the refrigerant in contact with exterior surface of the tubes. In a condenser application, refrigerant is cooled and condensed through heat transfer to the fluid through the walls of the tubes. The heat transfer capability of such a heat exchanger is largely determined by the heat transfer characteristics of the individual tubes and their position in the tube bundle.

There are generally two types of evaporator applications: flooded evaporators and falling film evaporators. In a flooded evaporator, liquid refrigerant is introduced in the lower part of the evaporator shell, and the level of liquid refrigerant in the evaporator shell is maintained sufficiently high so that all the tubes are positioned below the level of liquid refrigerant in the majority of operating conditions. As the heat is transferred from the water flowing inside the tubes to the refrigerant, the refrigerant is caused to boil, with the vapor passing to the surface where it is than drawn out of the evaporator by the compressor. In a falling film evaporator, the liquid refrigerant is distributed horizontally to a sprayer, located at the top of the evaporator and spayed so that as its falls, it contacts the outside surfaces of the tube bundle, the heat transfer with which causes it to evaporate. The refrigerant then flows by gravity from the top horizontal tubes to the bottom horizontal tubes while cooling the liquid flowing within the tubes.

There are a number of generally known methods of improving the heat transfer of a heat exchanger tube in the bundle by reducing an internal and external thermal resistance for the tube. One way is to increase the heat transfer area of the tube by way of placing a plurality of extended surface elements such as fins on the outer surface thereof. This can be accomplished by making the fins separately and attaching them to the outer surface of the tube, or by forming fins directly on the outer tube surface. Another approach is to roughen the outer surface of the tube so that the nucleation sites that are formed can improve the heat transfer characteristics of the tube surface. Obviously, the two approaches can be combined or superimposed in a single manufacturing process. Similarly, internal tube heat transfer characteristics can be improved. Also, as mentioned above, the tube spacing in the bundle becomes critical and has to be optimized.

It is desirable to have heat transfer tubes with external heat transfer surfaces that have good heat transfer performance in condensing and evaporating applications as well as for the flooded and falling film evaporator applications.

SUMMARY OF THE INVENTION

Briefly, in accordance with one aspect of the invention, the performance characteristics of a heat transfer tube are enhanced by forming the tube with a cross-section area that is elongated in one direction as compared with the traditional round tube.

By yet another aspect of the invention, the tubes are orientated with their elongated axis positioned in a vertical direction. In this way, enhanced heat transfer characteristics are obtained.

In the drawings as hereinafter described, a preferred and modified embodiments are depicted; however, various other modifications and alternate constructions can be made thereto without departing from the true spirit and scope of the invention.

DESCRIPTION OF THE PREFERRED EMBODIMENT

Figure 1:
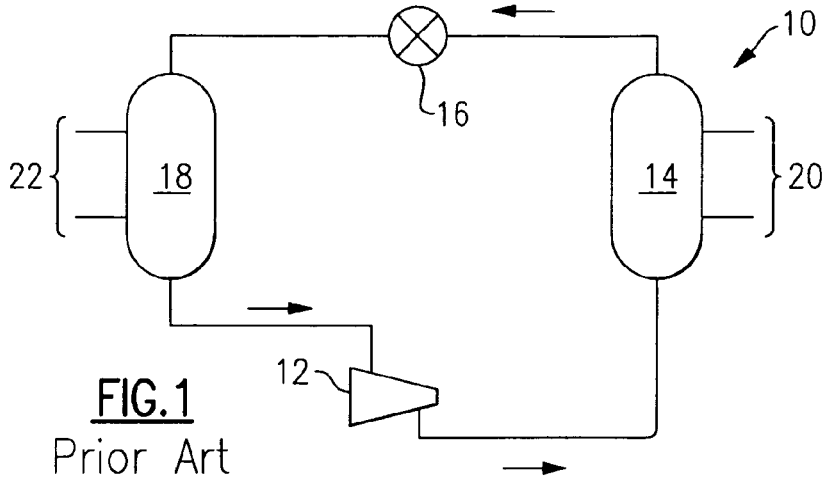
FIG.1 Prior Art
FIG. 1 is a schematic illustration of a prior art chiller system.

Referring to FIG. 1, there is illustrated a general configuration of a typical prior art chiller 10 having refrigerant flowing in a closed loop from a compressor 12, to a condenser 14, to an expansion device 16, to an evaporator 18 and then back to the compressor 12. In the condenser 14 the refrigerant is cooled by transfer of heat to a fluid flowing in a heat exchange relationship with the refrigerant. This fluid is typically a cooling fluid such as water supplied from a source 20. In the evaporator 18, water from a loop generally designated 22 flows in a heat exchange relationship to the refrigerant and is cooled by transferring heat to the refrigerant.

Figure 2:
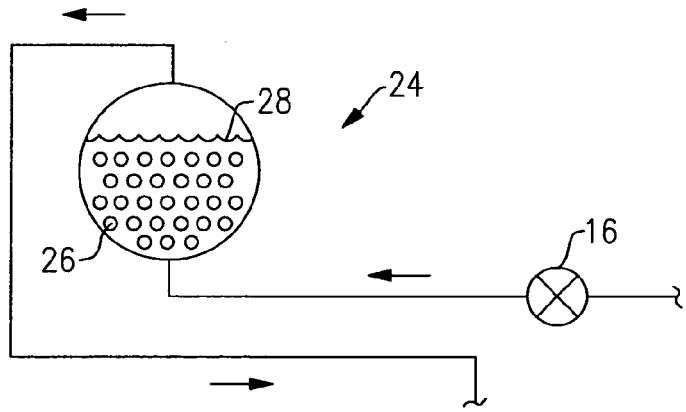
FIG.2 Prior Art
FIG. 2 is a schematic illustration of a portion of a prior art chiller system having a flooded evaporator.

FIG. 2 schematically illustrates a chiller 24 with a tube-and-shell evaporator operating in a flooded condition with all of the tubes 26 typically being below the refrigerant level 28 in a majority of the operational regimes and the refrigerant supplied at the bottom of the evaporator.

Figure 3:
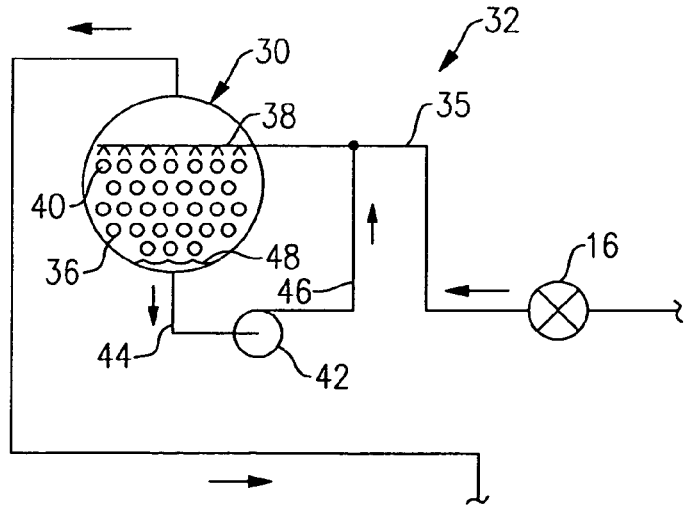
FIG.3 Prior Art
FIG. 3 is a schematic illustration of a portion of a prior art chiller system having a falling film evaporator.

FIG. 3 schematically illustrates a falling film tube-and-shell evaporator 30 in a chiller system 32. In contrast to the flooded evaporator illustrated in FIG. 2, it is known that the refrigerant flowing from the expansion device 16 flows by a supply line 35 into the evaporator shell to a dispensing device commonly known as a spray deck 38 overlying the uppermost level of tubes 40. A recirculation circuit, including a recirculating pump 42, draws liquid refrigerant that has not been evaporated from the bottom of the evaporator shell through line 44 and delivers it through line 46 to the supply line 35, where it is again distributed through the spray deck 38. The recirculation system thus ensures that there is adequate flow to the spray deck 38 to keep the tubes wetted.

Figure 4:
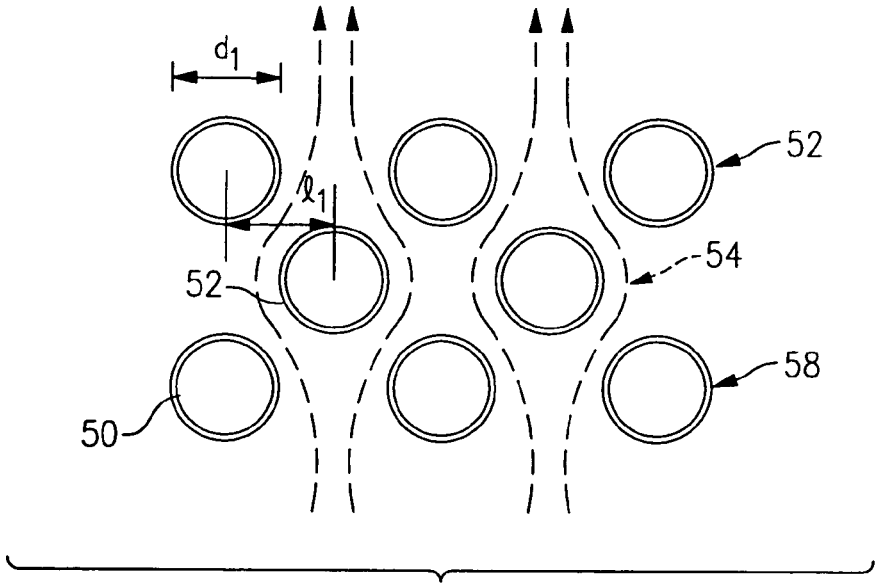
FIG.4 Prior Art
FIG. 4 is a schematic illustration of the flow path of refrigerant bubbles in a heat exchanger of the prior art.

As will be recognized, both the flooded evaporator shown in FIG. 2 and the falling film evaporator shown in FIG. 3 include heat transfer tubes that are round in their cross-section. FIG. 4 shows a plurality of such round tubes in a typical spaced relationship in the tube bundle for the flooded evaporator applications, with an indication shown in dashed lines of the path of refrigerant bubbles as they swirl around the tubes as they are formed, grow in size, and eventually rise to the top. Here, it has been recognized by the applicants that there are two phenomena that tend to restrict the free rise of the bubbles as they are formed in the nucleation process.

First, assuming that the tubes have a diameter "$d_1$", a bubble 52 which is forming at the lowermost portion of a tube as shown is restricted from its upward flow until the bubble grows large enough to overcome the restrictive forces and moves a distance comparable to $d_1/2$ in either direction before it can rise to the surface. Of course, bubbles forming at intermediate positions between the lowermost positions as shown and a position directly to the side of the tube, will be similarly, but less, restricted in its upward flow. The point is, this restriction to upward flow of bubbles extends over a distance comparable to "$d_1$" in the transverse direction for each of the tubes in the heat exchanger. The larger the bubble dimension, the more surface area it blocks from the liquid refrigerant to come into a direct contact with the tube surface, which is detrimental for the heat transfer. Obviously, the turbulent motion of pool boiling will promote bubble separation from the tube surface, but this process will be suppressed and delayed to some degree in any case.

The second phenomenon that tends to restrict upward flow is that of the limited lateral range of unrestricted corridors between tubes in the heat exchanger. This effect becomes even more pronounced at the top rows of the tube bundle, where refrigerant vapor quality and bubble velocity are much higher due to a number and size of the bubbles rising to the top. For the heat exchanger compactness (to have more heat transfer surface into a given volume), it is desirable to stagger the rows of tubes such that the distances between the tubes in vertical and horizontal directions are less the tube diameter, so alternate rows of the tubes overlap each other, as shown for adjacent rows 54, 56 and 58. It will, of course, be understood that as the tube diameter "$d_1$" is increased, the distance "$l_1$" between the centerlines of the adjacent tube rows has to decrease in a given volume and for a given tube count. The less restricted upward flow of the bubbles, as discussed hereinabove, is best accomplished by increasing the distance "$l_1$" and decreasing the tube diameter "$d_1$" that is impossible to accomplish for the round tubes without the heat transfer surface reduction and evaporator performance loss, as well as pressure drop increase inside the tubes and the corresponding power raise. Similarly, the tube count must be maintained at a certain level for the same purposes, with the higher tube count tending to decrease the distance $l_1$.

Figure 5:
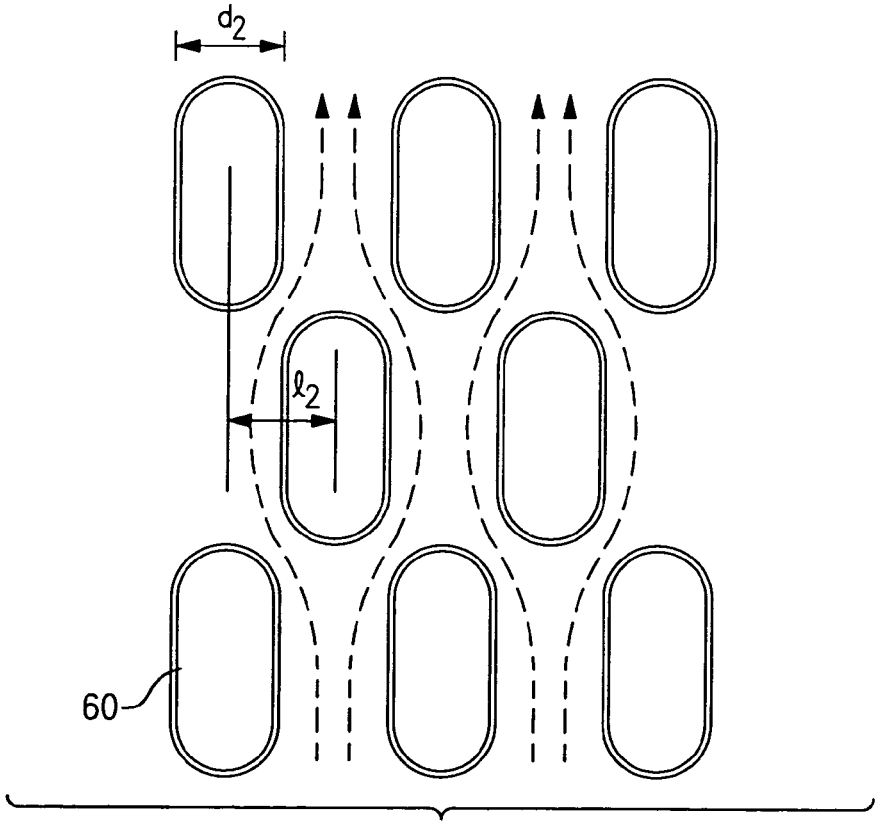
FIG. 5 is a schematic illustration of the flow path of refrigerant bubble in a heat exchanger in accordance with the present invention.

Shown in FIG. 5 is a plurality of evaporator tubes 60 in accordance with the present invention. As is seen, their elongated (non-round) cross-section areas are aligned in the vertical direction to generally coincide with the direction of the upward flow of the bubbles, as indicated by the arrows. Because of the elongated shape, the tubes 60 can have identical or similar cross-section area as the round tubes 50, and therefore have similar heat transfer surface amount and pressure drop characteristics and can carry the same volume of liquid to be cooled, but, as will be seen, the resistance to upward flow of the bubbles for these tubes is substantially reduced. That is, since the dimension $d_2$ is substantially less than the dimension $d_1$, the resistance to the flow of bubbles forming under the tubes is substantially less. Further, since the dimension $l_2$ is substantially greater than the dimension of $l_1$ of FIG. 4, the transverse dimension of the vertical corridor between the tubes is substantially greater than that for the round tubes. The result is that the FIG. 5 embodiment allows for easier upward movement of the bubbles formed on the outer surfaces of the tubes, especially at the top rows, and therefore improved heat exchanger performance. Further, since boiling heat transfer characteristics are improved, the tube length and tube count may be reduced to save cost and downsize the heat exchanger. Obviously, water-side pressure drop characteristics are to be considered simultaneously with the heat transfer characteristics to balance the overall system performance.

The advantages of the present invention as discussed hereinabove are equally applicable to flooded evaporators and to falling film evaporators as well as to condensers. In respect to falling film application, however, there are further advantages in using the heat transfer tubes with elongated cross-sections. In falling film applications, the refrigerant is dispersed from above the tube bank and tends to fall on the top surfaces of the tubes and run down the sides thereof. Generally, the lower surface of the tube is not effective in the heat transfer process. Accordingly, the elongated cross-section tubes provide more surface area over which spayed refrigerant comes into direct contact with the tube (i.e. over the topes and sides) than does the round tube. In other words, the round tube has more surface area of the ineffective bottom portion than does the elongated tube. These considerations are true for a falling film evaporator, wherein a liquid refrigerant is spread over the tube bank and for a falling film condenser wherein refrigerant vapor is distributed over the tube bank. Also, in the condenser applications, the lower portion of the tube becomes ineffective in the heat transfer process and may experience the refrigerant flow vertices or boundary layer separation conditions.

Figure 6:
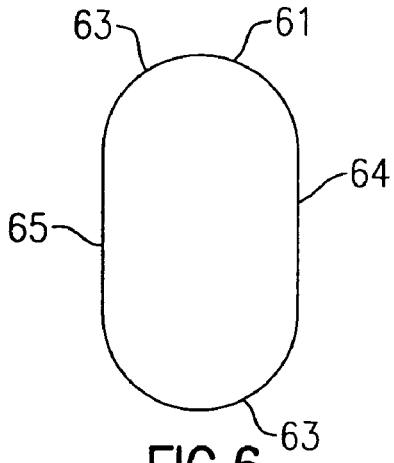
FIG. 6 is a cross-sectional view of a heat transfer tube in accordance with one embodiment of the invention.
Figure 7:
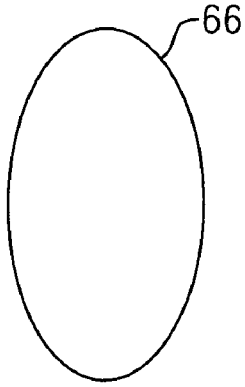
FIG. 7 is an alternative embodiment thereof.
Figure 8:
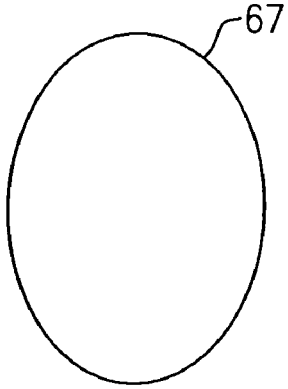
FIG. 8 is a further alternative embodiment thereof.

The elongated cross-section tubes can take various forms as shown in FIGS. 6–8. In FIG. 6, the cross-section area of the tube is a racetrack in form wherein the ends 62 and 63 are semi-circular in shape and the sides 64 and 65 are linear in shape. In FIG. 7, the cross-section area of the tube 66 is elliptical in form. In FIG. 8, the cross-section area of the tube 67 is generally oval in form. It will be understood, of course, that various other shapes may be employed so long as the tube is generally elongated in its cross-section in the vertical direction.

It should be understood that in addition to tubes made by the conventional methods the present invention is also applicable to tubes made by an extrusion process, such as those made for so-called minichannel heat exchangers.

While the present invention has been particularly shown and described with reference to preferred and alternate embodiments as illustrated in the drawings, it will be understood by one skilled in the art that various changes in detail may be effected therein without departing from the true spirit and scope of the invention as defined by the claims.

We claim:

1. A shell-and-tube heat exchanger with a plurality of tubes disposed in a shell and adapted to conduct a fluid to flow within; and a refrigerant supply means for providing refrigerant into said shell and contained within the volume formed by said shell and external surfaces of the tubes, such that heat transfer interaction between the fluid and the refrigerant causes the refrigerant being in contact with an external surface of the tubes to chance its thermodynamic state;

wherein the cross-section of said plurality of tubes is elongated in the vertical direction to allow for at least one of: easier upward movement of the vapor refrigerant within the shell, smaller size bubble formation and departure from the external surface of the tube, and more direct outer surface area exposure to the refrigerant.

2. A shell-and-tube heat exchanger as set forth in claim 1, wherein said refrigerant supply means is located at the bottom of said shell and further wherein a level of liquid refrigerant in said shell covers at least some of said plurality of tubes.

3. A shell-and-tube heat exchanger as set forth in claim 1, wherein said refrigerant supply means is located near a top of said shell and further wherein refrigerant is dispersed in a spray that falls downwardly over said plurality of said tubes.

4. A shell-and-tube heat exchanger as set forth in claim 1, wherein said refrigerant is in a liquid state.

5. A shell-and-tube heat exchanger as set forth in claim 1, wherein said refrigerant is a two-phase mixture.

6. A shell-and-tube heat exchanger as set forth in claim 1, wherein said refrigerant supply means is located near a top of said shell and further wherein refrigerant vapor is directed to flow downwardly over said plurality of said tubes to be condensed.

7. A shell-and-tube heat exchanger as set forth in claim 1, wherein said tube cross-section is a racetrack in shape.

8. A shell-and-tube heat exchanger as set forth in claim 1, wherein said cross-section of said tubes is oval in shape.

9. A shell-and-tube heat exchanger as set forth in claim 1, wherein said cross-section of said tubes is elliptical in shape.

10. A shell-and-tube heat exchanger as set forth in claim 1 wherein said refrigerant vapor is in the form of bubbles moving generally upwardly through a pool of liquid refrigerant.

11. A heat exchanger for receiving refrigerant flow from an expansion device and delivering refrigerant vapor to a compressor comprising:

a shell fluidly communicating with both the expansion device and the compressor such that refrigerant flows into said shell; and a plurality of heat transfer tubes disposed within said shell and adapted to conduct the flow of fluid, such that heat transfer interaction between the fluid and the refrigerant causes the refrigerant being in contact with an external surface of the tubes to change its thermodynamic state;

wherein said plurality of tubes are formed such that they are elongated in their cross-section to allow for at least one of: easier upward movement of the vapor within the shell, smaller size bubble formation and departure from the external surface of the tube, and more direct outer surface area exposure to the refrigerant.

12. A heat exchanger as set forth in claim 11, wherein said plurality of heat transfer tubes are horizontally disposed and further wherein said tubes are elongated in a vertical direction.

13. A heat exchanger as set forth in claim 11, wherein said heat exchanger is a flooded evaporator with refrigerant being received at a lower portion thereof.

14. A heat exchanger as set forth in claim 11, wherein said heat exchanger is a falling film evaporator and further wherein said refrigerant is received near its upper portion thereof.

15. A heat exchanger as set forth in claim 11, wherein said heat exchanger is a condenser and said refrigerant is received near an upper portion thereof and removed at a bottom of the heat exchanger.

16. A heat exchanger as set forth in claim 11, wherein said refrigerant is supplied in a liquid state.

17. A heat exchanger as set forth in claim 11, wherein said refrigerant is supplied as a two-phase mixture.

18. A shell-and-tube heat exchanger as set forth in claim 11 wherein said refrigerant vapor is in the form of vapor particles rising through a dispersed liquid refrigerant sprayed on the outer surface of the tubes.

* * * * *

UNITED STATES PATENT AND TRADEMARK OFFICE

CERTIFICATE OF CORRECTION

PATENT NO. : 7,228,711 B2
APPLICATION NO. : 10/986685
DATED : June 12, 2007
INVENTOR(S) : Taras et al.

It is certified that error appears in the above-identified patent and that said Letters Patent is hereby corrected as shown below:

Col. 1, Line 54. The words "where it is than drawn out" should be deleted and replaced with --where it is then drawn out--.

Col. 1, Lines 57 and 58. The words "located at the top of the evaporator and spayed so that as its falls," should be deleted and replaced with --located at the top of the evaporator and sprayed so that as it falls,--.

Col. 4, Lines 44 and 45. The words "over which spayed refrigerant" should be deleted and replaced with --over which sprayed refrigerant--.

Col. 4, Lines 45 and 46. The words "(i.e. over the topes and sides)" should be deleted and replaced with --(i.e. over the tops and sides)--.

Col. 5, Lines 18 and 19. The words "to chance its thermodynamic state" should be deleted and replaced with --to change its thermodynamic state--.

Signed and Sealed this

Eighteenth Day of September, 2007

JON W. DUDAS
*Director of the United States Patent and Trademark Office*